US011065522B1

(12) United States Patent
Begley

(10) Patent No.: US 11,065,522 B1
(45) Date of Patent: Jul. 20, 2021

(54) GOLF SWING TRAINING DEVICE AND METHOD OF USE

(71) Applicant: John Paul Begley, Wellington, FL (US)

(72) Inventor: John Paul Begley, Wellington, FL (US)

( * ) Notice: Subject to any disclaimer, the term of this patent is extended or adjusted under 35 U.S.C. 154(b) by 0 days.

(21) Appl. No.: 16/713,927

(22) Filed: Dec. 13, 2019

Related U.S. Application Data

(60) Provisional application No. 62/779,464, filed on Dec. 13, 2018.

(51) Int. Cl.
*A63B 69/36* (2006.01)
*A63B 69/00* (2006.01)

(52) U.S. Cl.
CPC ..... *A63B 69/0059* (2013.01); *A63B 69/3608* (2013.01); *A63B 69/3621* (2020.08)

(58) Field of Classification Search
CPC ..... A63B 69/0059; A63B 69/3621; A63B 69/3608
See application file for complete search history.

(56) References Cited

U.S. PATENT DOCUMENTS 5,839,968 A 11/1998 Latella
6,458,036 B1 10/2002 Gutierrez
7,648,422 B2 1/2010 Brooks et al.
9,682,304 B2 * 6/2017 Vilhelmsen ..... A63B 69/3623
2005/0049068 A1 * 3/2005 Chang ..... A63B 69/3608 473/276
2006/0040757 A1 2/2006 Rosselli
2008/0153615 A1 * 6/2008 Baird ..... A63B 69/3608 473/207
2012/0184388 A1 * 7/2012 Clark ..... A63B 69/3608 473/276
2012/0264535 A1 10/2012 O'Brien
2013/0267334 A1 10/2013 Valle
2015/0224382 A1 * 8/2015 Hall ..... A63B 69/0002 473/450

OTHER PUBLICATIONS

Medicus Core Links—Swing Core Trainer: Link: "https://www.amazon.com/Medicus-RMG-0000620-Core-Links-Red/dp/B002DU1MES/ref=sr_1_1?dchild=1&keywords=Medicus+Core+Li".

* cited by examiner

*Primary Examiner* — Nini F Legesse
(74) *Attorney, Agent, or Firm* — Allen D. Hertz, P.A.; Allen D. Hertz

(57) ABSTRACT

A golf backswing training device comprising a body. The body is formed having a unitary construction formed in a hollow oblate (flattened) hemispheroid shape, including a golf backswing training device body front panel, a golf backswing training device body rear panel and an arched segment extending therebetween. The golf backswing training device body front panel and rear panel are designed having like half elliptical shapes. The body is fabricated of a flexible, rigid material having a modulus of elasticity enabling the body to be compressed when a force is applied and returning to the original shape when the force is removed. The golf backswing training device is placed proximate a golfer's arm pit for use. The golfer would retain the body in position during a swing. This positions an arm of the golfer in a proper position during a backswing, thus creating proper muscle memory, thus improving the golfer's game.

20 Claims, 7 Drawing Sheets

GOLF SWING TRAINING DEVICE AND METHOD OF USE

CROSS REFERENCE TO RELATED APPLICATIONS

This Application is a Non-Provisional Application claiming the benefit of Provision Patent Application Ser. No. 62/779,464, filed on Dec. 13, 2018, which is incorporated herein in its entirety.

FIELD OF THE INVENTION

The present invention relates generally to the field of golf training devices and more specifically relates to a golf training device provided for a golfer to use to improve several aspects of the golf swing, focusing on the backswing.

DESCRIPTION OF THE RELATED ART

A golfer is continuously working to improve their game. One method to improve a golfer's game can be accomplished by paying close attention to how the player practices and prepares to play each round of golf. As a player, the player needs to work on all the areas to which the game presents obstacles, like the long game, the iron game, and the short game.

Players need to be aware of their fundamentals, and certain key thoughts for making repetitive, simple golf swings. The backswing position of the golf swing is one of the most crucial positions that needs to be executed properly and practiced repeatedly. To some of the best players in the world, the backswing sets the tone for the rest of the motions proceeding during an actual swing. Learning how to rotate the torso without lifting or separating the player's arms from their body too much allows the player to generate incredible amounts of stored energy thus allowing the player to consistently deliver that power to the golf ball time and time again, all the while, making the swing appear smooth and effortless, mimicking how some special players are able to do.

Various attempts have been made to solve problems found in golf training device art. Among these are found in: U.S. Publication No. 2012/0264535 to Frank O'Brien; U.S. Pat. No. 7,648,422 to Brooks et al; U.S. Pat. No. 6,458,036 to Robert Gutierrez; U.S. Publication No. 2013/0267334 to Reinhard A. Valle; U.S. Pat. No. 5,839,968 to Frank A. Latella; and U.S. Publication No. 2006/0040757 to Matteo Rosselli. This prior art is representative of golf training device. A need exists for a reliable training device to help train muscle memory to the golfer. The subject invention provides a device and a method of use which trains a player to avoid the above-mentioned problems.

BRIEF SUMMARY OF THE PRESENT INVENTION

In view of the foregoing disadvantages inherent in the known art, the present invention provides a novel device for training a golfer to improve their backswing motion. The general purpose of the present invention, which will be described subsequently in greater detail, is to provide a simple golf training device, which all players can use to improve several aspects of the golf swing, focusing on the backswing, which leads to further fundamental improvements.

The present invention, referred to as a golf backswing training device, includes a hollow oblate (flattened) hemispheroid. The hollow oblate (flattened) hemispheroid is formed having a first partial (half) elliptically shaped side, a second partial (half) elliptically shaped side, and a curved surface joining the outer peripheral edges of the first partial (half) elliptically shaped side and the second partial (half) elliptically shaped side. A seam tape can be provided around the exposed surface about an open edge of the device. A loop can be attached at a central location of each elongated, linear edge of each respective first partial (half) elliptically shaped side and second partial (half) elliptically shaped side. The golf backswing training device is formed of a flexible material that retains a preformed shape.

A dense hook and loop tape can be secure on an interior surface of each of the first partial (half) elliptically shaped side and the second partial (half) elliptically shaped side at a location proximate the linear edge thereof. The dense hook and loop tape is provided as a device which retains the linear, free edges of the first partial (half) elliptically shaped side and the second partial (half) elliptically shaped side attached to one another.

In an alternative configuration, the loops can be secured to one another using a ring, a clip, or any other suitable fastening device to retain the linear, free edges of the first partial (half) elliptically shaped side and the second partial (half) elliptically shaped side attached to one another.

A retraction device includes a tether having a length, a spool for collecting and dispensing a length of the tether, and a retraction mechanism which enables dispensing and provides retraction of the tether by controlling a motion of the tether spool. The tether can be secured to one or both of the loops by a mechanical attachment element or assembly. The retraction device is utilized to aid the Golfer in temporarily supporting the golf backswing training device when the golf backswing training device is not in use. In one configuration, a belt clip can be included with the retraction device for securing the retraction device to the golfer during use.

In one aspect, a golf backswing training device comprising:

- a golf backswing training device body having a hollow oblate hemispheroid shape, the hollow oblate hemispheroid having a golf backswing training device body front panel and a golf backswing training device body rear panel comprising an arched segment therebetween,
- wherein the golf backswing training device body front panel is configured having a half of an elliptical shape,
- wherein the golf backswing training device body rear panel is configured having a half of an elliptical shape.

In a second aspect, the golf backswing training device body front panel and the golf backswing training device body front panel are of a like shape and size.

In another aspect, the hollow oblate hemispheroid shaped portion of the golf backswing training device body is of a unitary construction.

In yet another aspect, the body is fabricated of a flexible, substantially rigid material having a modulus of elasticity enabling the body to be partially compressed when a force is applied and returning to the original shape when the force is removed.

In yet another aspect, the hollow oblate hemispheroid shape is fabricated of a vinyl material.

In yet another aspect, the golf backswing training device body is fabricated having an external casing and an interior fill, creating a pillow.

In yet another aspect, the golf backswing training additionally includes a body free edge seam finish assembled to a free edge of the golf backswing training device body.

In yet another aspect, the golf backswing training additionally includes a body free edge seam finish assembled to a free edge of the golf backswing training device body, wherein the body free edge seam finish is of a soft, pliant material.

In yet another aspect, the golf backswing training additionally includes a body free edge seam finish assembled to a free edge of the golf backswing training device body, wherein the body free edge seam finish is of a soft, pliant material, such as a fabric.

In yet another aspect, the golf backswing training additionally includes a body free edge seam finish assembled to a free edge of the golf backswing training device body, wherein the body free edge seam finish is of a soft, pliant material, such as a woven material.

In yet another aspect, the golf backswing training additionally includes a body free edge seam finish assembled to a free edge of the golf backswing training device body, wherein the body free edge seam finish is of a soft, pliant material, such as a knit material.

In yet another aspect, the golf backswing training additionally includes a tether attached to the golf backswing training device body.

In yet another aspect, the golf backswing training additionally includes a retracting tether assembly having a retractable tether, wherein the retractable tether is attached to the golf backswing training device body.

In yet another aspect, the golf backswing training additionally includes a retracting tether assembly having a retractable tether, wherein the retractable tether is attached to the golf backswing training device body.

In an aspect directed towards a method of use, the method comprising steps of:

placing a golf backswing training device between a golfer's torso and a golfer's upper arm of a golfer, the golf backswing training device comprising:

a golf backswing training device body having a golf backswing training device body front panel and a golf backswing training device body rear panel comprising an interior gap therebetween, wherein the golf backswing training device body is fabricated of a flexible material, wherein the golf backswing training device is of a design and material that compresses when a compression force is applied to the golf backswing training device body front panel and the golf backswing training device body rear panel and the golf backswing training device body returns to an original shape when the compression force applied to the golf backswing training device body front panel and the golf backswing training device body rear panel is removed;

applying a force to each of the golf backswing training device body front panel and the golf backswing training device body rear panel, wherein the force compresses the golf backswing training device and wherein the force is sufficient to retain the golf backswing training device in position throughout a golf swing; and swinging a golf club using both arms while retaining the golf backswing training device in position.

In a second aspect, the golf backswing training device body has a hollow oblate hemispheroid shape, the hollow oblate hemispheroid includes a golf backswing training device body front panel and a golf backswing training device body rear panel attached to one another along an arched segment, wherein the golf backswing training device body front panel is configured having a half of an elliptical shape, wherein the golf backswing training device body rear panel is configured having a half of an elliptical shape, the method further comprising a step of:

orienting the arched segment towards an armpit of the golfer.

In another aspect directed towards a method of use, the golf backswing training device body is fabricated of a flexible and resilient material, the method further comprising steps of:

utilizing the flexible and resilient material enabling contraction of the golf backswing training device body when a compression force is applied to the golf backswing training device body; and utilizing the flexible and resilient material for returning the golf backswing training device body to an original shape when the compression force applied to the golf backswing training device body front panel and the golf backswing training device body rear panel is removed.

In another aspect directed towards a method of use, the golf backswing training device body is fabricated of a flexible and resilient vinyl material, the method further comprising steps of:

utilizing the flexible and resilient vinyl material enabling contraction of the golf backswing training device body when a compression force is applied to the golf backswing training device body; and utilizing the flexible and resilient vinyl material for returning the golf backswing training device body to an original shape when the compression force applied to the golf backswing training device body front panel and the golf backswing training device body rear panel is removed.

In another aspect directed towards a method of use, the golf backswing training device body is a pillow having a fill material located within the interior gap, the method further comprising steps of:

utilizing the fill material enabling contraction of the golf backswing training device body when a compression force is applied to the golf backswing training device body; and utilizing the fill material for returning the golf backswing training device body to an original shape when the compression force applied to the golf backswing training device body front panel and the golf backswing training device body rear panel is removed.

In another aspect directed towards a method of use, the golf backswing training device body further comprising a tether, the method further comprising steps of:

removing the force to each of the golf backswing training device body front panel and the golf backswing training device body rear panel; and supporting the golf backswing training device using the tether.

In another aspect directed towards a method of use, the golf backswing training device body further comprising a retractable tether operated by a retracting mechanism, the method further comprising steps of:

removing the force to each of the golf backswing training device body front panel and the golf backswing training device body rear panel;

supporting the golf backswing training device using the retractable tether; and retracting the retractable tether, drawing the golf backswing training device body towards the retracting mechanism.

In an aspect directed towards a second method of use, the method comprising steps of:

placing a golf backswing training device between a golfer's torso and a golfer's upper arm of a golfer, the golf backswing training device comprising:

a golf backswing training device body having a hollow oblate hemispheroid shape, the hollow oblate hemispheroid having a golf backswing training device body front panel and a golf backswing training device body rear panel comprising an arched segment therebetween, wherein the golf backswing training device body front panel is configured having a half of an elliptical shape, wherein the golf backswing training device body rear panel is configured having a half of an elliptical shape, wherein the golf backswing training device is fabricated of at least one material enabling the golf backswing training device body to be partially compressed when a force is applied and returning the golf backswing training device body to the original shape when the force is removed;

applying a force to each of the golf backswing training device body front panel and the golf backswing training device body rear panel, wherein the force compresses the golf backswing training device and wherein the force is sufficient to retain the golf backswing training device in position throughout a golf swing; and swinging a golf club using both arms while retaining the golf backswing training device in position.

In an aspect directed towards a third method of use, the method comprising steps of:

placing a golf backswing training device between a golfer's torso and a golfer's upper arm of a golfer, the golf backswing training device comprising:

a golf backswing training device body having a golf backswing training device body front panel and a golf backswing training device body rear panel comprising an interior gap therebetween, wherein the golf backswing training device body is fabricated of a flexible, material, wherein the golf backswing training device is of a design and material that compresses when a compression force is applied to the golf backswing training device body front panel and the golf backswing training device body rear panel and the golf backswing training device body returns to an original shape when the compression force applied to the golf backswing training device body front panel and the golf backswing training device body rear panel is removed;

applying a force to each of the golf backswing training device body front panel and the golf backswing training device body rear panel, wherein the force compresses the golf backswing training device and wherein the force is sufficient to retain the golf backswing training device in position throughout a golf swing; and swinging a golf club using both arms while retaining the golf backswing training device in position.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION OF THE PRESENT INVENTION

When playing a game of golf, a Golf player is striving to play each round of golf using a minimal number of strokes. The Golf player can continuously work to improve their body form while swinging the club during a process of teeing off and for each resulting subsequent stroke.

The present invention introduces a golf training device, and more particularly, a golf backswing training device. The golf backswing training device is designed to be an affordable training device and can be used by players at all levels, including women, men, amateurs, children, high school and collegiate teams, professional players and professional instructors.

A golf swing can vary, where a poor golf swing provides minimal control on direction and/or force. Each swing is critical in final placement of the golf ball on the golf course. Creating correct muscle memory for each style of swing will improve a golf player's score.

Figure 1:
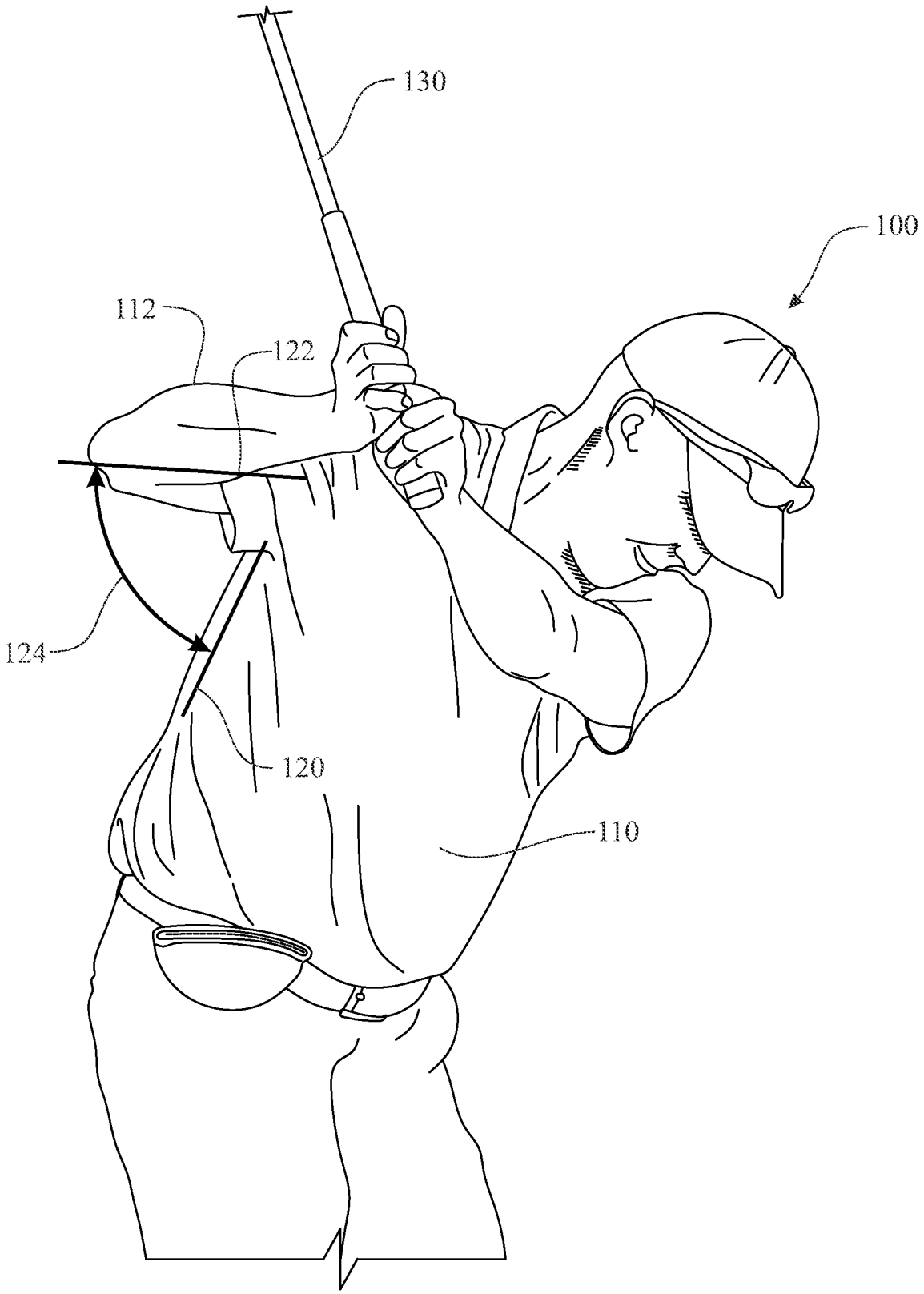
FIG. 1 presents a golfer in a position during a backswing, the illustration presenting an incorrect posture during a backswing portion of a golf stroke.
Figure 2:
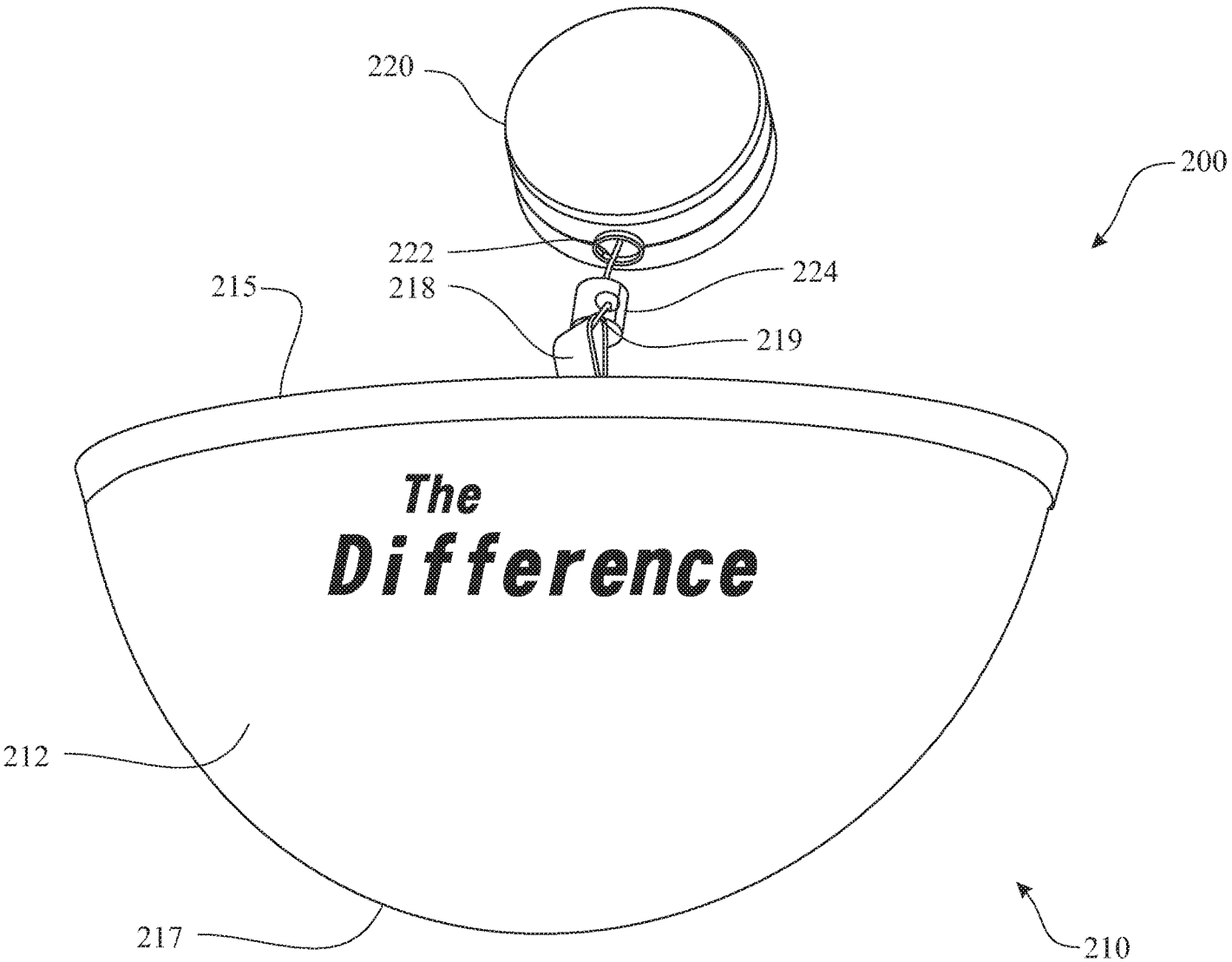
FIG. 2 presents a plan view of an exemplary golf backswing training device in accordance with the present invention.

An example relative to the affectivity of the present invention is presented in FIG. 1. The illustration presents a golfer 100 having an incorrect posture for a backswing of a golf club 130. The golfer 100 is shown raising the golfer's upper arm 112 to an angle from the golfer's torso reference 120 that is incorrect. The angle, identified as a golfer's upper arm angular relation 124, is referenced between a golfer's upper arm orientation 122 (reference of an orientation of the golfer's upper arm 112) and a golfer's torso reference 120 (reference to an orientation of the golfer's torso 110. It is found that if the golfer 100 maintains a specific golfer's upper arm angular relation 124 during a backswing, as shown in FIG. 7, the force and direction provided to the golf ball is significantly better compared to a backswing having an incorrect golfer's upper arm angular relation 124, as shown in FIG. 1.

Figure 3:
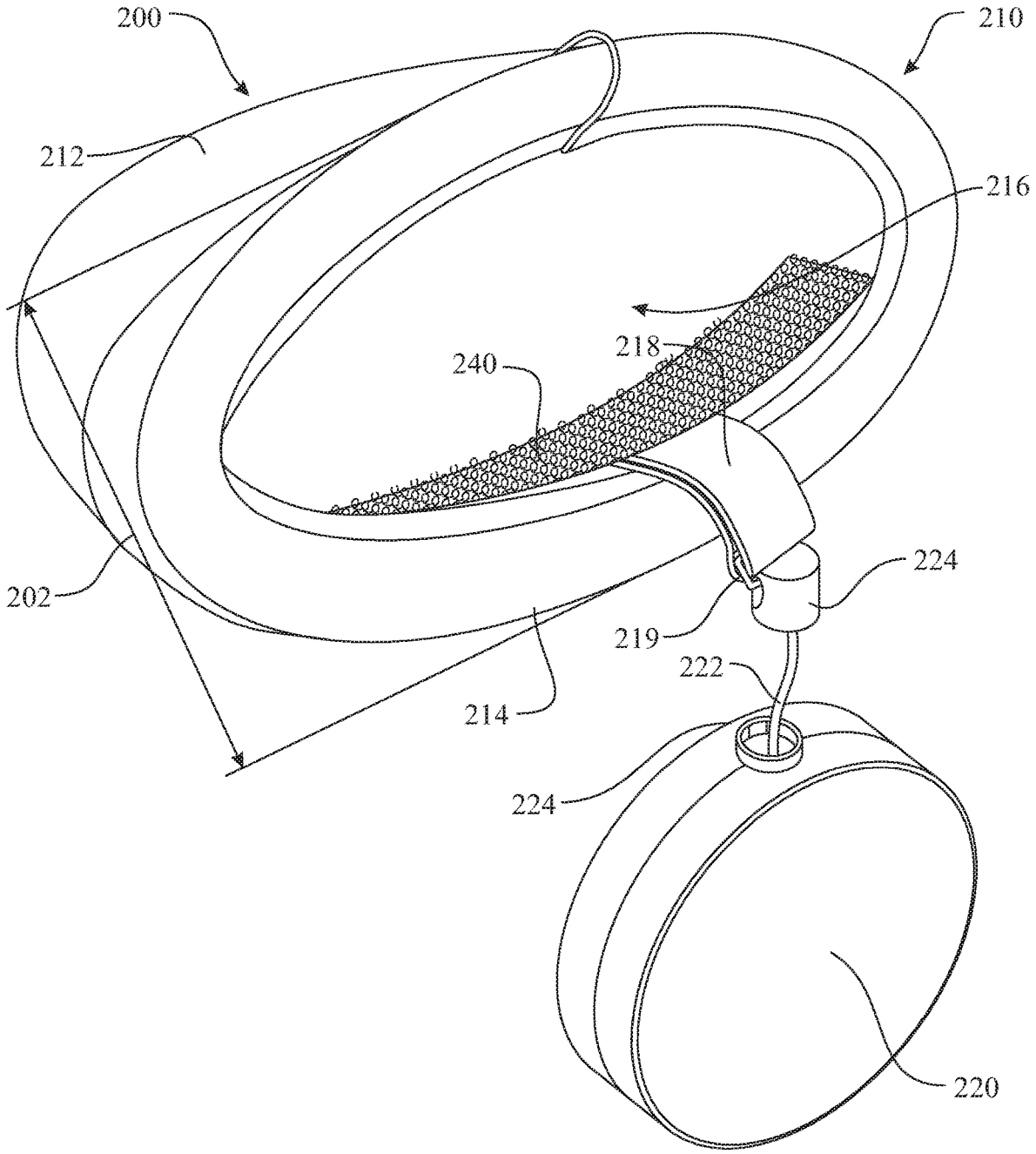
FIG. 3 presents a bottom isometric view of the exemplary golf backswing training device originally introduced in FIG. 1.
Figure 5:
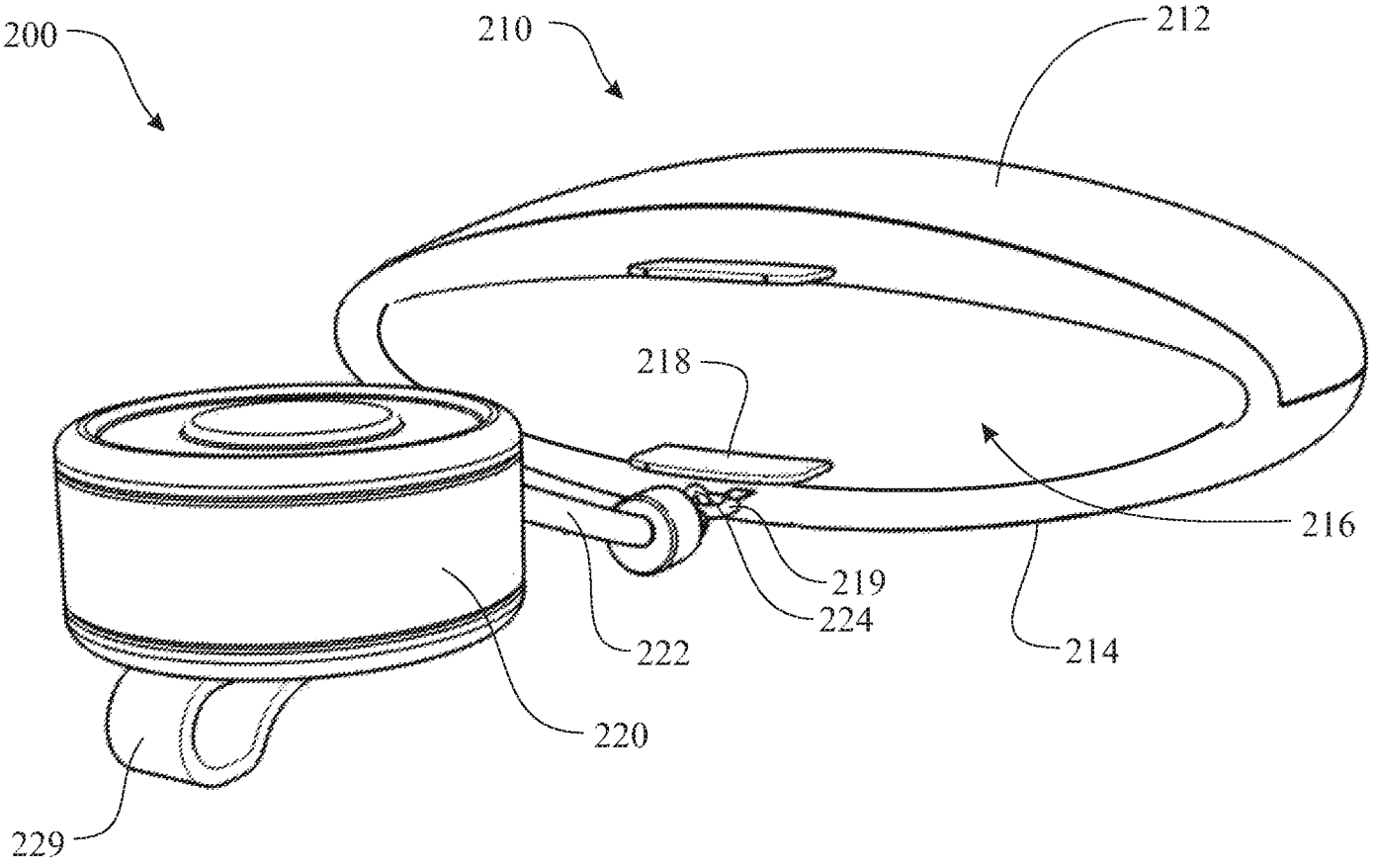
FIG. 5 presents a bottom front isometric view of the exemplary golf backswing training device originally introduced in FIG. 1.
Figure 6:
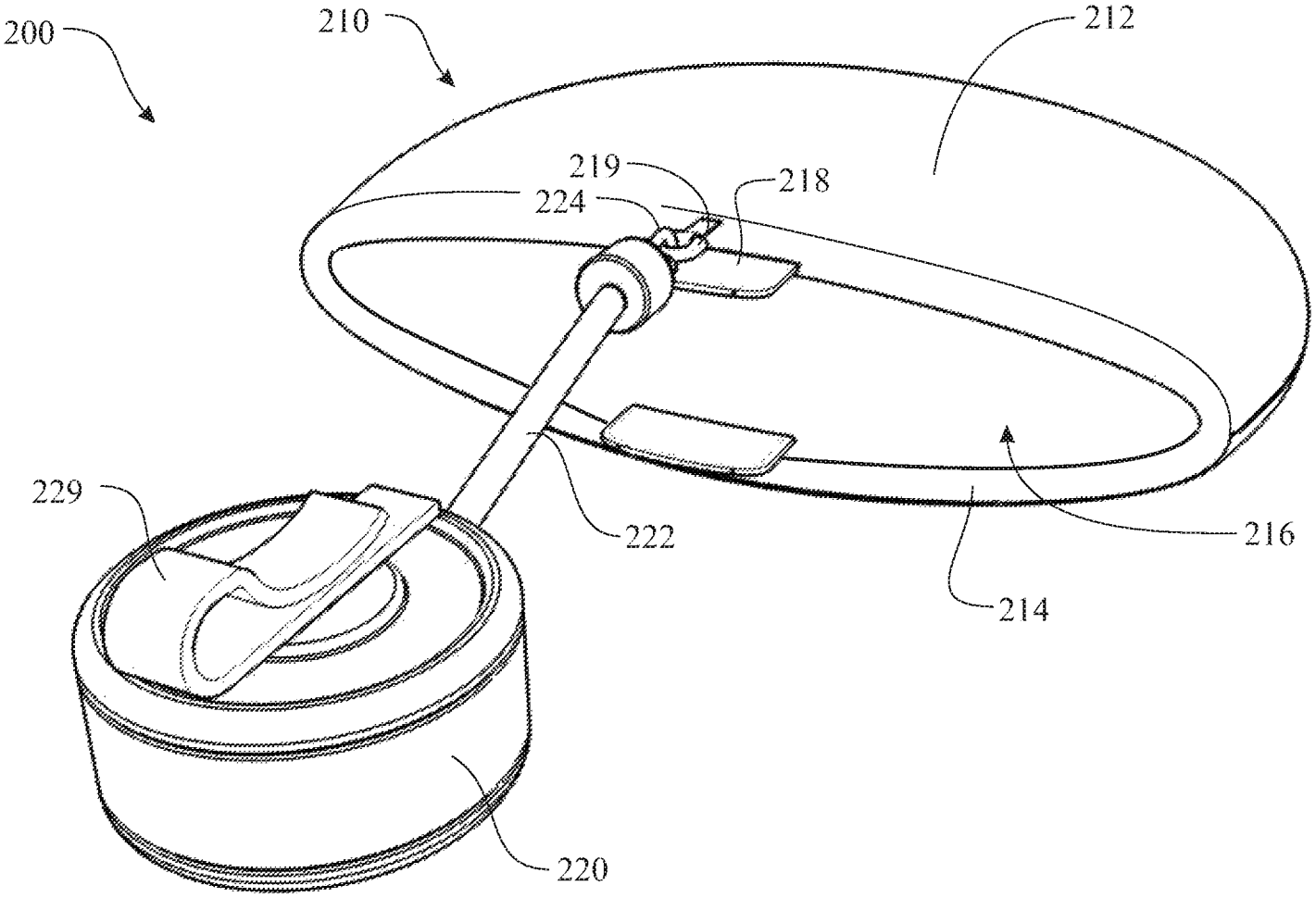
FIG. 6 presents a bottom rear isometric view of the exemplary golf backswing training device originally introduced in FIG. 1.
Figure 7:
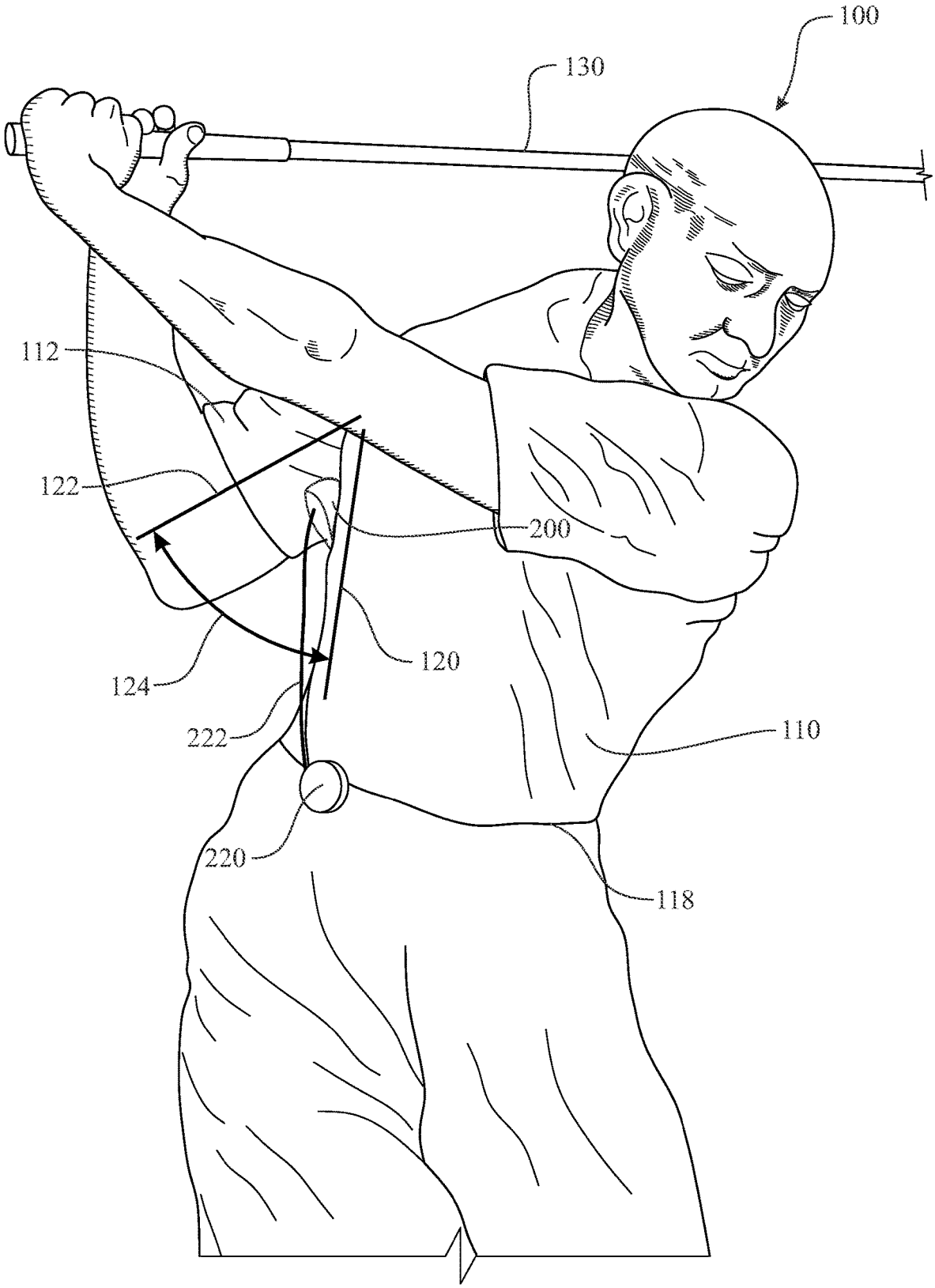
FIG. 7 presents a golfer in a position during a backswing, the illustration presenting the golfer using the golf backswing training device, which directs the Golfer into a correct posture during the backswing portion of the golf stroke.

The golfer 100 can improve their backswing by using a golf backswing training device 200, introduced and described in FIGS. 2 through 6 and illustrated in use in FIG. 7. The golf backswing training device 200 includes a golf backswing training device body 210. The golf backswing training device body 210 can be fabricated having a unitary construction. The golf backswing training device body 210 can be fabricated of a semi-rigid material that has some flexure when subjected to a force and returns to a natural shape when the force is removed. A shape of the golf backswing training device body 210 can be described as including a golf backswing training device body front panel 212 having one half of an elliptical shape when viewing the golf backswing training device body 210 from a first side and a golf backswing training device body rear panel 214 having a like shape when viewing the golf backswing training device body 210 from a second side, the second side being opposite of the first side. The golf backswing training device body front panel 212 and the golf backswing training device body rear panel 214 are joined to one another by an arched transition section 217. The arched transition section 217 providing a portion of the flexure of the golf backswing training device body 210. The golf backswing training device body front panel 212 is bound by a golf backswing training device body front panel free edge (a portion of the golf backswing training device body free edge seam finish 215 associated with the golf backswing training device body front panel 212) and a golf backswing training device body front panel adjoining edge (a portion of the arched transition section 217 associated with the golf backswing training device body front panel 212). The golf backswing training device body rear panel 214 is bound by a golf backswing training device body rear panel free edge (a portion of the golf backswing training device body free edge seam finish 215 associated with the golf backswing training device body rear panel 214) and a golf backswing training device body rear panel adjoining edge (a portion of the arched transition section 217 associated with the golf backswing training device body rear panel 214). The planar portion of the golf backswing training device body front panel 212 and the golf backswing training device body rear panel 214 contributing to the flexure of the golf backswing training device body 210. The combination of the golf backswing training device body front panel 212 and the golf backswing training device body rear panel 214 form a hollow oblate (flattened) hemispheroid. A golf backswing training device body interior 216 is created within an interior region between interior surfaces of the golf backswing training device body front panel 212 and the golf backswing training device body rear panel 214, as best shown in FIG. 3. The golf backswing training device body interior 216 provides a distance between the golf backswing training device body front panel 212 and the golf backswing training device body rear panel 214. The shape of the golf backswing training device body 210 creates a span between exterior training device body surfaces 202 between exterior surfaces of the golf backswing training device body 210, or the exterior surface of the golf backswing training device body front panel 212 and the exterior surface of the golf backswing training device body rear panel 214. The span between exterior training device body surfaces 202 would be such to properly position a golfer's upper arm 112 during a swing. The golf backswing training device body 210 terminates along a free edge. An exterior surface of the golf backswing training device body 210 is preferably fabricated of a durable, water resistant, vinyl material. The exterior can be of any of a variety of solid colors, a plurality of colors, one or more prints, one or more patterns, adorned with text, one or more logos, one or more designs, artwork, and the like. A golf backswing training device body free edge seam finish 215 can be assembled to the golf backswing training device body 210, covering the free edge of the golf backswing training device body 210. The golf backswing training device body free edge seam finish 215 can be fabricated of any suitable material, including a bias tape, a Lycra tape, a woven material, a non-woven material, leather, and the like. The golf backswing training device body free edge seam finish 215 can encapsulate a padding to improve comfort to the user.

Figure 4:
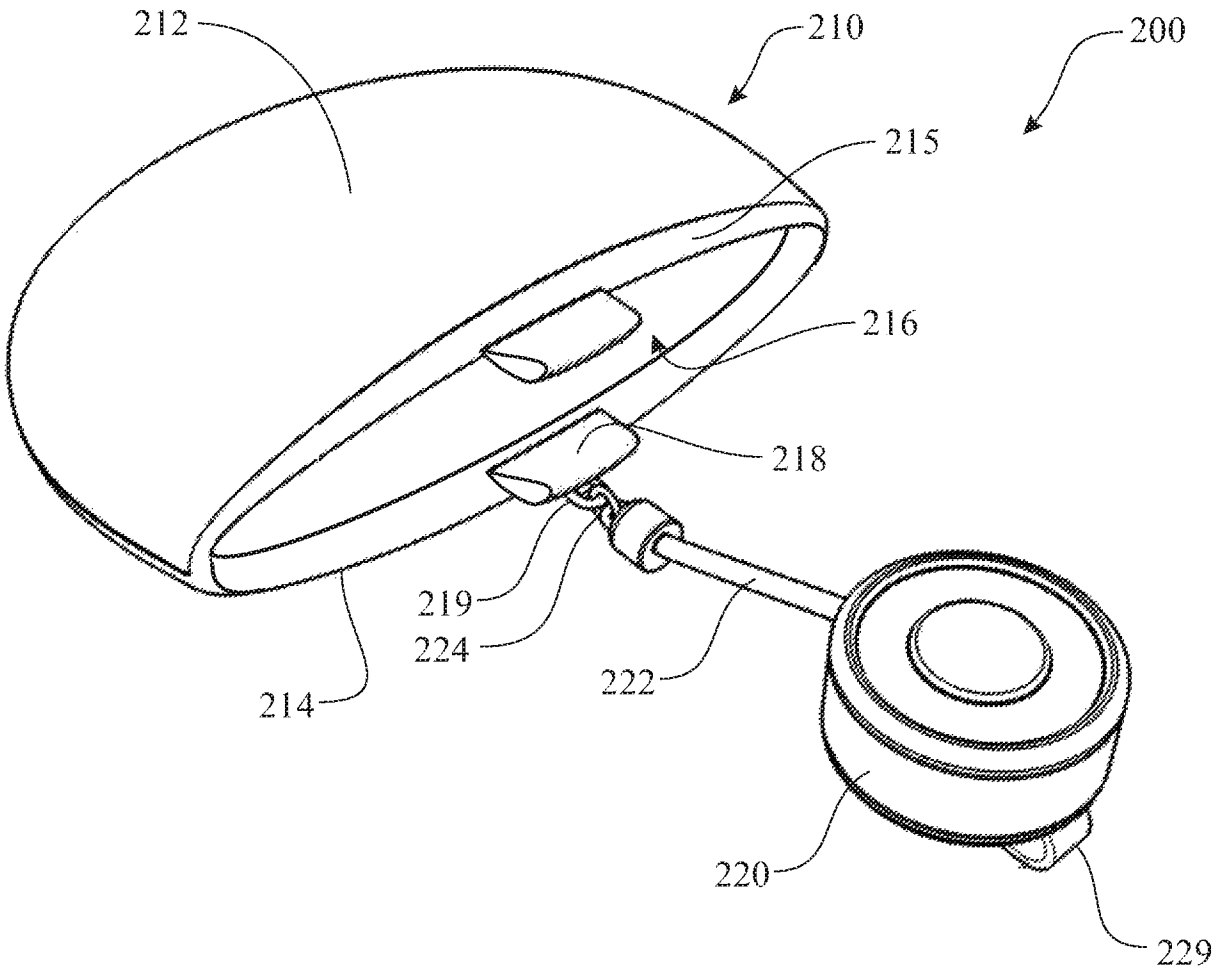
FIG. 4 presents a front bottom isometric view of the exemplary golf backswing training device originally introduced in FIG. 1.

A anchor element 218 can be assembled to the golf backswing training device body 210 at a location proximate a center of the free edge of a respective golf backswing training device body front panel 212 or golf backswing training device body rear panel 214. A second anchor element 218 can be assembled to the golf backswing training device body 210 at a location proximate a center of the free edge of a respective other golf backswing training device body rear panel 214 or golf backswing training device body front panel 212. The anchor element 218 can be provided as a loop, as shown in FIG. 3, a tab, as shown in FIGS. 4 through 6, or any other suitable shape. When provided as a loop, the loop can be fabricated of a strip of canvas (as shown, a ribbon, a woven or non-woven fabric, leather, or of any other suitable material. The loop can be attached using stitching, adhesive, a mechanical fastener, a dense hoot and loop tape, or any other attachment process. The loop provides a formation enabling attachment of the golf backswing training device 200 to a retracting tether assembly 220. An attachment element 219 can be assembled to the loop, as best shown in FIG. 3. When provided as a tap, the tab can be fabricated of plastic, nylon, a composite material, canvas, leather, or any other suitable material. The tab can be attached using stitching, adhesive, a mechanical fastener, a dense hoot and loop tape, or any other attachment process. Alternatively, the tab can be fabricated of the same material as the golf backswing training device body 210 and can either be assembled to the golf backswing training device body 210 or fabricated as a portion of the golf backswing training device body 210. When fabricated as a portion of the golf backswing training device body 210, the tab and the golf backswing training device body 210 would be of a unitary construction. The tab can include an aperture, wherein the aperture provides a formation enabling attachment of the golf backswing training device 200 to a retracting tether assembly 220.

A dense hook and loop tape 240 can be assembled to an interior surface of the golf backswing training device body 210. More specifically, a first portion of the dense hook and loop tape 240 can be assembled to the interior surface of the golf backswing training device body front panel 212 (as shown in FIG. 3) and a second, mating portion of the dense hook and loop tape 240 can be assembled to the interior surface of the golf backswing training device body rear panel 214. The segments of the dense hook and loop tape 240 can be assembled to the respective interior surfaces of the golf backswing training device body front panel 212 and the golf backswing training device body rear panel 214 using an adhesive, stitching, or any other suitable assembly configuration. The dense hook and loop tape 240 and the mating material provides a mechanism to temporarily join the opposing free edges of the golf backswing training device body front panel 212 and the golf backswing training device body rear panel 214 to one another, thus minimizing a distance between the opposing free edges of the golf backswing training device body front panel 212 and the golf backswing training device body rear panel 214. Alternative elements can be employed to achieve the same results. For example, a magnet and a magnetically attracting material or another magnet can be utilized providing the same function.

A retracting tether assembly 220 can be secured to the golf backswing training device body 210 by way of the anchor element 218. A tether attachment element 224 is carried at a distal or free end of a tether 222. The tether 222 can be fabricated of a cording, a chain, a cable, and the like. The tether 222 is retractably dispensed by a direction controlled spool. The direction controlled spool enables the tether 222 to be drawn from the spool and retracted onto the spool when desired. The attachment element 219 and the tether attachment element 224 are assembled to one another, securing the golf backswing training device body 210 and the retracting tether assembly 220 to one another. The attachment element 219 and the tether attachment element 224 can be provided in any reasonable configuration, including those that are illustrated, a lobster claw connection, a spring clip connection, a snap, or any other releasable mechanical fastener.

A temporary mounting clip 229 can be assembled to a housing of the retracting tether assembly 220. The temporary mounting clip 229 provides a function of retaining the retracting tether assembly 220 to a person (such as a golf player). The temporary mounting clip 229 can be provided as a single component formed of a spring steel, a mechanical subassembly provided as an alligator clip, or any other suitable attachment configuration.

In use, the golf backswing training device body 210 of the golf backswing training device 200 is placed between the golfer's upper arm 112 and the golfer's torso 110 of the golfer 100, as illustrated in FIG. 7. The golfer 100 would secure the retracting tether assembly 220 to a garment, such as a belt, a waistband, and the like. It would be preferred to locate the retracting tether assembly 220 on the garment at a location that is underneath a trailing arm of the golfer 100. The user would then locate the golf backswing training device body 210 between the golfer's upper arm 112 and the golfer's torso 110 of the golfer 100 by drawing the tether 222 from the retracting tether assembly 220. The user would then locate the golf backswing training device body 210 between the golfer's upper arm 112 and the golfer's torso 110 of the golfer 100, more specifically within an armpit region of the golfer 100.

The golf backswing training device body 210 allows the golfer 100 to develop memory muscle associated with a proper backswing position. The golf backswing training device body 210 directs the user to maintain a proper golfer's upper arm angular relation 124, as illustrated in FIG. 7. The golf backswing training device body 210 is formed having a suitable spacing between the golf backswing training device body front panel 212 and the golf backswing training device body rear panel 214. The golfer 100 is required to apply pressure to the golf backswing training device body 210 to maintain the golf backswing training device body 210 in position during use. The span between the golf backswing training device body front panel 212 and the golf backswing training device body rear panel 214 maintains proper spacing between the golf backswing training device body front panel 212 and the golf backswing training device body rear panel 214, thus achieving a proper golfer's upper arm angular relation 124.

Once the player has completed the swing, the user would release the golf backswing training device body 210 from between their golfer's upper arm 112 and their golfer's torso 110, allowing the retracting tether assembly 220 to retract the tether 222 onto the spool. The retracted tether 222 supports the golf backswing training device body 210 at a location proximate a housing of the retracting tether assembly 220. This retains the golf backswing training device body 210 at a convenient location until the next use. Any golfer 100 can use the golf backswing training device 200 to practice at driving ranges, golf courses, and even in their very own backyards. A pair of anchor elements 218 at the top of the bag are pulled to separate the dense hook and loop tape 240 holding the golf backswing training device body front panel 212 and the golf backswing training device body rear panel 214 proximate one another.

The retracting tether assembly 220 can be stored within the golf backswing training device body interior 216 of the golf backswing training device body 210 and the dense hook and loop tape 240 and the mating section of the dense hook and loop tape 240 can be joined to one another when the golf backswing training device 200 is not in use, making the golf backswing training device 200 portable, and of a size and shape that is suitable for storage within a pocket of a golf bag.

In an alternative embodiment, the golf backswing training device body 210 can be fabricated of a soft and slightly puffy design, such as a small pillow. In this embodiment, pillow stuffing or other pillow fill material can be inserted into the golf backswing training device body interior 216. The golf backswing training device body free edge seam finish 215 can be converted into a closure, encasing the pillow fill material within the golf backswing training device body interior 216. This configuration can be held in the arm pit area very comfortably, requiring only a slightest force to hold the golf backswing training device body 210 in place.

The unique features of the golf backswing training device 200 will provide the following benefits for all golfers 100 who want to improve their game: The golf backswing training device 200 improves the position of the players' arms and the golf club 130 at the top of the backswing (as shown in FIG. 7) allowing the golfer 100 to feel the proper rotation of their body without lifting or separating of their arms from the golfer's torso 110 during the golf swing; A simple, effective, cost efficient, self-contained, convenient and fun multi-use training device for every golfer; and it is portable, compact, and easy to use. Golfers 100 will not be embarrassed while practicing with the golf backswing training device 200 in public.

The embodiments of the invention described herein are exemplary and numerous modifications, variations and rearrangements can be readily envisioned to achieve substantially equivalent results, all of which are intended to be embraced within the spirit and scope of the invention.

REFERENCE ELEMENT DESCRIPTIONS

Ref No. Description

100 golfer
110 golfer's torso
112 golfer's upper arm
120 golfer's torso reference
122 golfer's upper arm orientation
124 golfer's upper arm angular relation
130 golf club
200 golf backswing training device

202 span between exterior training device body surfaces
210 golf backswing training device body
212 golf backswing training device body front panel
214 golf backswing training device body rear panel
215 golf backswing training device body free edge seam finish
216 golf backswing training device body interior
217 arched transition section
218 anchor element
219 attachment element
220 retracting tether assembly
222 tether
224 tether attachment element
229 temporary mounting clip
240 dense hook and loop tape

What is claimed is:

1. A method of improving a golf swing, the method comprising steps of:

placing a golf backswing training device between a golfer's torso and a golfer's upper arm of a golfer, the golf backswing training device comprising:

a golf backswing training device body having a golf backswing training device body front panel and a golf backswing training device body rear panel comprising an interior gap therebetween, the golf backswing training device body front panel bound by a golf backswing training device body front panel adjoining edge and a golf backswing training device body front panel free edge and the golf backswing training device body rear panel bound by a golf backswing training device body rear panel adjoining edge and a golf backswing training device body rear panel free edge, wherein the golf backswing training device body front panel adjoining edge and the golf backswing training device body rear panel adjoining edge are joined to one another and the golf backswing training device body front panel free edge and the golf backswing training device body rear panel free edge are detached and spaced apart from one another when the golf backswing training device body is in an original shape, wherein the golf backswing training device body is fabricated of a flexible, resilient material, wherein the golf backswing training device is of a design and material that compresses when a compression force is applied to the golf backswing training device body front panel and the golf backswing training device body rear panel and the golf backswing training device body returns to an original shape when the compression force applied to the golf backswing training device body front panel and the golf backswing training device body rear panel is removed;

applying a force to each of the golf backswing training device body front panel and the golf backswing training device body rear panel, wherein the force compresses the golf backswing training device against a resistance force generated by properties of the flexible, resilient material of the golf backswing training device body drawing the golf backswing training device body front panel free edge and the golf backswing training device body rear panel free edge towards one another, and wherein the force is sufficient to retain the golf backswing training device in position throughout a golf swing;

swinging a golf club using both arms while retaining the golf backswing training device in position; and restoring the golf backswing training device body to the original shape using the properties of the flexible, resilient material of the golf backswing training device body.

2. A method of improving a golf swing as recited in claim 1, the golf backswing training device body having a hollow oblate hemispheroid shape, the hollow oblate hemispheroid, wherein the golf backswing training device body front panel adjoining edge and the golf backswing training device body rear panel adjoining edge are formed as and joined along an arched segment, wherein the golf backswing training device body front panel is configured having a half of an elliptical shape, wherein the golf backswing training device body rear panel is configured having a half of an elliptical shape, the method further comprising a step of:

orienting the arched segment towards an armpit of the golfer.

3. A method of improving a golf swing as recited in claim 1, the golf backswing training device body further comprising a tether, the method further comprising steps of:

removing the force to each of the golf backswing training device body front panel and the golf backswing training device body rear panel; and supporting the golf backswing training device using the tether.

4. A method of improving a golf swing as recited in claim 1, the golf backswing training device body further comprising a retractable tether operated by a retracting mechanism, the method further comprising steps of:

removing the force to each of the golf backswing training device body front panel and the golf backswing training device body rear panel;

supporting the golf backswing training device using the retractable tether; and retracting the retractable tether, drawing the golf backswing training device body towards the retracting mechanism.

5. A method of improving a golf swing as recited in claim 1, the golf backswing training device body further comprising a tether, the method further comprising steps of:

removing the force to each of the golf backswing training device body front panel and the golf backswing training device body rear panel; and supporting the golf backswing training device using the tether.

6. A method of improving a golf swing as recited in claim 1, the golf backswing training device body further comprising a retractable tether operated by a retracting mechanism, the method further comprising steps of:

removing the force to each of the golf backswing training device body front panel and the golf backswing training device body rear panel;

supporting the golf backswing training device using the retractable tether; and retracting the retractable tether, drawing the golf backswing training device body towards the retracting mechanism.

7. A method of improving a golf swing as recited in claim 1, the golf backswing training device body front panel adjoining edge having an arched shape and the golf backswing training device body front panel free edge having a linear edge, the golf backswing training device body rear panel adjoining edge having an arched shape and the golf backswing training device body rear panel free edge having a linear edge, the method further comprising a step of:

orienting the arched segment towards an armpit of the golfer.

8. A method of improving a golf swing as recited in claim 1, the golf backswing training device further comprising a golf backswing training device body free edge seam finish covering the golf backswing training device body front panel free edge and the golf backswing training device body rear panel free edge, the method further comprising a step of:

improving comfort to the user.

9. A method of improving a golf swing as recited in claim 1, the golf backswing training device body further comprising a first closure element provided on an interior surface of the golf backswing training device body front panel at a location proximate the golf backswing training device body front panel free edge and a second, mating closure element provided on an interior surface of the golf backswing training device body rear panel at a location proximate the golf backswing training device body rear panel free edge, the method further comprising a step of:

joining the first closure element and the second mating closure element to one another.

10. A method of improving a golf swing as recited in claim 9, wherein the first closure element is one of a first portion of a dense hook and loop tape or a magnet and the second, mating closure element is one of a second, mating portion of the dense hook and loop tape or a magnetically attracted material, the method further comprising one of the following steps of:

joining the first portion of a dense hook and loop tape and the second mating portion of a dense hook and loop tape to one another, or joining the magnet and the magnetically attracted material to one another.

11. A method of improving a golf swing, the method comprising steps of:

placing a golf backswing training device between a golfer's torso and a golfer's upper arm of a golfer, the golf backswing training device comprising:

a golf backswing training device body having a hollow oblate hemispheroid shape, the hollow oblate hemispheroid having a golf backswing training device body front panel and a golf backswing training device body rear panel comprising an arched segment therebetween, wherein the golf backswing training device body front panel is configured having a half of an elliptical shape bound by a golf backswing training device body front panel adjoining edge and a golf backswing training device body front panel free edge, wherein the golf backswing training device body rear panel is configured having a half of an elliptical shape bound by a golf backswing training device body rear panel adjoining edge and a golf backswing training device body rear panel free edge, wherein the golf backswing training device body front panel adjoining edge and the golf backswing training device body rear panel adjoining edge are joined to one another and the golf backswing training device body front panel free edge and the golf backswing training device body rear panel free edge are detached and spaced apart from one another when the golf backswing training device body is in an original shape, wherein the golf backswing training device body is fabricated of a flexible and resilient material enabling the golf backswing training device body to be partially compressed when a force is applied and returning the golf backswing training device body to the original shape when the force is removed;

applying a force to each of the golf backswing training device body front panel and the golf backswing training device body rear panel, wherein the force compresses the golf backswing training device against a resistance force generated by properties of the flexible, resilient material of the golf backswing training device body drawing the golf backswing training device body front panel free edge and the golf backswing training device body rear panel free edge towards one another, and wherein the force is sufficient to retain the golf backswing training device in position throughout a golf swing;

swinging a golf club using both arms while retaining the golf backswing training device in position; and restoring the golf backswing training device body to the original shape using the properties of the flexible, resilient material of the golf backswing training device body.

12. A method of improving a golf swing as recited in claim 11, wherein the golf backswing training device body front panel and the golf backswing training device body front panel are of a like shape and size.

13. A method of improving a golf swing as recited in claim 11, the method further comprising a step of:

orienting the arched segment towards an armpit of the golfer.

14. A method of improving a golf swing as recited in claim 11, wherein the golf backswing training device body is fabricated of a vinyl material, the method further comprising steps of:

utilizing the vinyl material for compression the golf backswing training device body; and utilizing the vinyl material for returning the golf backswing training device body to the original shape when the compression force applied to the golf backswing training device body front panel and the golf backswing training device body rear panel is removed.

15. A method of improving a golf swing as recited in claim 11, the golf backswing training device further comprising a tether, the method further comprising steps of:

removing the force to each of the golf backswing training device body front panel and the golf backswing training device body rear panel; and supporting the golf backswing training device using the tether.

16. A method of improving a golf swing as recited in claim 11, the golf backswing training device further comprising a retractable tether operated by a retracting mechanism, the method further comprising steps of:

removing the force to each of the golf backswing training device body front panel and the golf backswing training device body rear panel;

supporting the golf backswing training device using the retractable tether; and retracting the retractable tether, drawing the golf backswing training device body towards the retracting mechanism.

17. A method of improving a golf swing as recited in claim 11, the golf backswing training device body further comprising a first closure element provided on an interior surface of the golf backswing training device body front panel at a location proximate the golf backswing training device body front panel free edge and a second, mating closure element provided on an interior surface of the golf backswing training device body rear panel at a location proximate the golf backswing training device body rear panel free edge, the method further comprising a step of:

joining the first closure element and the second mating closure element to one another.

18. A method of improving a golf swing, the method comprising steps of:

placing a golf backswing training device between a golfer's torso and a golfer's upper arm of a golfer, the golf backswing training device comprising:

a golf backswing training device body having a golf backswing training device body front panel configured having an arched surface bound by a golf backswing training device body front panel adjoining edge and a golf backswing training device body front panel free edge extending between ends of the golf backswing training device body front panel adjoining edge, a golf backswing training device body rear panel configured having an arched surface bound by a golf backswing training device body rear panel adjoining edge and a golf backswing training device body rear panel free edge extending between ends of the golf backswing training device body rear panel adjoining edge, and an interior gap therebetween the golf backswing training device body front panel and the golf backswing training device body rear panel and the golf backswing training device body front panel free edge and the golf backswing training device body rear panel free edge are detached and spaced apart from one another when the golf backswing training device body is in an original shape, wherein the golf backswing training device body is fabricated of a flexible and resilient material, wherein the golf backswing training device is of a design and material that compresses when a compression force is applied to the golf backswing training device body front panel and the golf backswing training device body rear panel and the golf backswing training device body returns to an original shape when the compression force applied to the golf backswing training device body front panel and the golf backswing training device body rear panel is removed;

applying a force to each of the golf backswing training device body front panel and the golf backswing training device body rear panel, wherein the force compresses the golf backswing training device against a resistance force generated by properties of the flexible, resilient material of the golf backswing training device body drawing the golf backswing training device body front panel free edge and the golf backswing training device body rear panel free edge towards one another, and wherein the force is sufficient to retain the golf backswing training device in position throughout a golf swing;

swinging a golf club using both arms while retaining the golf backswing training device in position; and restoring the golf backswing training device body to the original shape using the properties of the flexible, resilient material of the golf backswing training device body.

19. A method of improving a golf swing as recited in claim 1, the method further comprising a step of:

orienting the arched segment towards an armpit of the golfer.

20. A method of improving a golf swing as recited in claim 18, the golf backswing training device body further comprising a first closure element provided on an interior surface of the golf backswing training device body front panel at a location proximate the golf backswing training device body front panel free edge and a second, mating closure element provided on an interior surface of the golf backswing training device body rear panel at a location proximate the golf backswing training device body rear panel free edge, the method further comprising a step of:

joining the first closure element and the second mating closure element to one another.

* * * * *